United States Patent [19]

Kashima et al.

[11] Patent Number: 4,658,774

[45] Date of Patent: Apr. 21, 1987

[54] IGNITION APPARATUS FOR INTERNAL COMBUSTION ENGINES

[75] Inventors: Osamu Kashima, Kariya; Masamichi Shibata, Anjo, both of Japan

[73] Assignee: Nippondenso Co., Ltd., Kariya, Japan

[21] Appl. No.: 792,923

[22] Filed: Oct. 30, 1985

Related U.S. Application Data

[62] Division of Ser. No. 501,765, Jun. 6, 1983, Pat. No. 4,557,229.

[30] Foreign Application Priority Data

| | | | |
|---|---|---|---|
| Jun. 7, 1982 | [JP] | Japan | 57-98367 |
| Jun. 7, 1982 | [JP] | Japan | 57-98366 |
| Jun. 28, 1982 | [JP] | Japan | 57-110952 |

[51] Int. Cl.[4] ..... F02P 1/00

[52] U.S. Cl. ..... 123/169 E; 123/169 EL

[58] Field of Search ..... 123/169 CA, 169 E, 169 EL, 123/169 MG, 169 P

[56] References Cited

U.S. PATENT DOCUMENTS

| | | | |
|---|---|---|---|
| 578,266 | 3/1897 | Rowbotham | 123/169 MG |
| 582,540 | 5/1897 | Mueller | 123/169 E |
| 858,196 | 6/1907 | Marshal | 123/169 EL |
| 1,848,065 | 3/1932 | Rabezzana | 123/169 E |
| 1,982,866 | 12/1934 | Guziel | 123/169 P |
| 4,177,783 | 12/1979 | Palomeque | 123/169 MG |
| 4,557,229 | 12/1985 | Kashima | 123/169 EL |

FOREIGN PATENT DOCUMENTS

| | | | |
|---|---|---|---|
| 460774 | 12/1950 | Italy | 123/169 P |
| 52-156242 | 12/1977 | Japan | 123/169 |
| 53-37245 | 4/1978 | Japan | 123/169 |
| 99121 | 8/1921 | Switzerland | 123/169 E |

*Primary Examiner*—Ronald B. Cox

*Attorney, Agent, or Firm*—Cushman, Darby & Cushman

[57] ABSTRACT

An improved ignition apparatus for an internal combustion engine includes at least an ignition coil and a first electrode assembly and a second electrode assembly, each thereof including an electrode, and each of the electrodes of the first and second electrode assemblies is electrically connected to one end of a secondary winding of an ignition coil. The electrodes are supported on a cylinder head of the engine being electrically insulated therefrom and they form a spark gap for producing spark discharge therebetween, and a high tension circuit connecting the electrodes to the secondary winding of the ignition coil is electrically insulated from the body of the engine. The ignition apparatus having the above-described construction has the functional effects of improving the ignition performance, simplifying the withstant voltage design of constituent components, improving the antifouling performance at a spark gap portion and increasing the radio frequency interference suppression performance.

12 Claims, 38 Drawing Figures

| IGNITION APPARATUS | | SPARK PLUG | |
|---|---|---|---|
| CIRCUIT | MOUNTING | MOUNTING THREAD EXTERNAL DIAMETER | GAP |
| FIG. 1 | FIG. 7 | mm 10φ | mm 0.7 |
| FIG. 4 | FIG. 6 | 10φ | 0.7 |
| FIG. 1 | FIG. 8 | 14φ | 0.7 |

| IGNITION APPARATUS | | SPARK PLUG | |
|---|---|---|---|
| CIRCUIT | MOUNTING | MOUNTING THREAD EXTERNAL DIAMETER | GAP |
| | | mm | mm |
| FIG. 1 | FIG. 8 | 14φ | 0.7 |
| FIG. 4 | FIG. 26 | 10φ | 0.7 |

| IGNITION APPARATUS | | SPARK PLUG | |
|---|---|---|---|
| CIRCUIT | MOUNTING | MOUNTING THREAD EXTERNAL DIAMETER | GAP |
| | | mm | mm |
| FIG. 32 | FIG. 33 | 10φ | 0.7 |
| FIG. 1 | FIG. 34 | 14φ | 0.7 |

IGNITION APPARATUS FOR INTERNAL COMBUSTION ENGINES

This is a division of application Ser. No. 501,765 filed June 6, 1983 now U.S. Pat. No. 4,557,229.

BACKGROUND OF THE INVENTION

1. Field of the Invention

The present invention relates to an ignition apparatus for internal combustion engines.

2. Description of the Prior Art

The ignition apparatus of a conventional internal combustion engine is constructed as shown in FIG. 1 or 2 so that a current supplied from a battery 1 having one of its terminals grounded flows to ground through a primary winding 3*a* of an ignition coil 3 and a breaker 2. A high voltage induced in the ignition coil 3 is delivered from one end (FIG. 1) or respective ends (FIG. 2) of a secondary winding 3*b* and applied to a terminal or terminals of a spark plug or spark plugs 4, respectively. Also, a conventional spark plug 4 is constructed as shown in FIG. 3 so that a terminal a and a center electrode f are fixed to each other with an electrically conductive glass seal g to provide electrical conduction therebetween, while, they are also electrically insulated from a metallic shell d by an insulator b. The metallic shell d has a mounting screw for mounting the plug on the engine and it is adapted to be tightly screwed into a cylinder head of the engine with a gasket k intervening therebetween. A ground electrode e is attached to an end surface of the metallic shell d by welding or the like and thus it has electrical conduction with the cylinder head. Formed between the center electrode f and the ground electrode e is a spark gap h for causing spark discharge therethrough.

The operation of this prior art apparatus is such that a high voltage supplied from the secondary winding 3*b* of the ignition coil 3 is applied to the center electrode f through the terminal a of the spark plug 4 and spark discharge occurs through the spark gap h as the applied voltage exceeds the sparking voltage of the spark gap h thereby igniting a mixture gas.

Recently, there has been a strong demand for the improvement of various performances of the spark plug itself, e.g., the promotion of ignition performance, the improved resistance to fouling and the reduced radio frequency interference. However, there is a limit in satisfying these requirements sufficiently only through modifications of the construction of the spark plug itself.

SUMMARY OF THE INVENTION

The inventors have devoted themselves to the research and development of the ignition apparatus taking a broader view of the ignition apparatus including spark plugs and have discovered that the previously mentioned performances can be improved greatly by improving the prior art apparatus shown in FIGS. 1 and 2. In other words, the present invention bids defiance to the established concept of prior art apparatuses to have one of the two electrodes of a spark plug connected to the body of a vehicle and simultaneously a high tension circuit including the spark plug and the secondary winding of an ignition coil connected to the vehicle body.

Thus, it is an object of the present invention to provide a construction in which a spark gap for causing spark discharge therethrough is formed between two electrodes which are electrically insulated from a cylinder head of an internal combustion engine and each of the electrodes is electrically connected to one end of the secondary winding of an ignition coil, that is, a construction in which a high tension circuit including at least one secondary winding and two electrodes is electrically insulated from the body of the engine.

By virtue of the ignition apparatus for an internal combustion engine according to the present invention, there can be obtained a number of remarkable advantages that the ignition capability is increased, that the withstand voltage design of the components of the ignition apparatus is simplified, that the occurrence of radio freqeuency interference is greatly suppressed, that the resistance to fouling occuring at the discharge electrodes is increased greatly, that the occurrence of excessive concentration of the field intensity between the discharge electrodes is eliminated thereby preventing variations in the sparking voltage and abnormal wear of the discharge electrodes, and further that the opposing surface areas of the discharge electrodes are increased thereby causing the temperature of the discharge electrodes to be elevated and the sparking voltage to be decreased.

DESCRIPTION OF THE PREFERRED EMBODIMENTS

Figure 4:
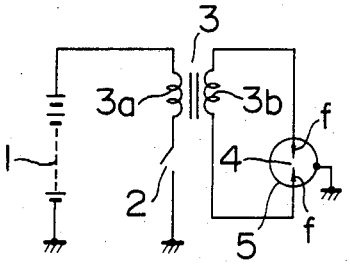
FIG. 4 is a circuit diagram showing an ignition apparatus of a first embodiment of this invention.

Concrete embodiments of this invention will now be described in detail with reference to the accompanying drawings. In the accompanying drawings, the same reference numerals or symbols designate the same or equivalent elements. Referring to FIG. 4, there is illustrated an electric circuit of a first embodiment of this invention which is applied to a vehicle having a single-cylinder two-cycle internal combustion gasoline engine, e.g., an autobicycle. In the Figure, a positive terminal of a power source or a battery 1 is electrically connected to a primary winding 3*a* of an ignition coil 3 and the primary winding 3*a* is electrically connected to a negative terminal of the power source 1 through contact points 2. On the other hand, two electrodes f of a spark plug 4 are electrically connected to the ends of a secondary winding 3*b* of the ignition coil 3, respectively. The two electrodes f of the spark plug 4 are exposed to the inside of the respective combustion chambers 5 of the engine and a spark discharge gap is formed between the two electrodes f. The electrodes f of the spark plug 4 are not electrically connected to the engine and consequently they are not connected (grounded) to the vehicle body (or a chassis of the autobicycle). It should be noted that in the Figure the ground circuit of the engine indicates a common ground circuit and it does not show that the electrodes f themselves are grounded.

Figure 5:
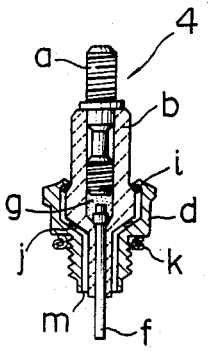
FIG. 5 PRIOR ART
FIG. 5 is a sectional view of a spark plug for use in the apparatus of this invention shown in FIG. 4.
Figure 6:
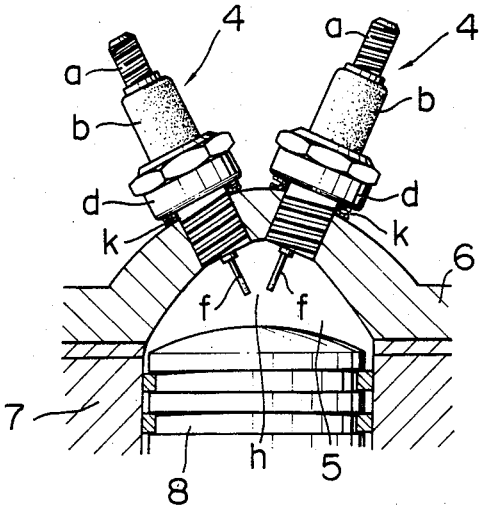
FIG. 6 PRIOR ART
FIG. 6 is a partially sectional view showing a state of mounting the spark plugs shown in FIG. 5 on a cylinder head of an engine.

Next, the detailed construction of the spark plug 4 for use in the apparatus of the first embodiment of this invention and a manner of mounting the spark plug 4 on the engine will be described with reference to FIGS. 5 and 6. The construction of the spark plug 4 shown in FIGS. 5 and 6 are the same with the conventional construction shown in FIG. 3 excepting that the spark plug 4 shown in FIGS. 5 and 6 does not have a ground electrode, as will be seen from FIG. 5. Thus, a detailed description thereof will be omitted. The spark plugs 4 each thereof having the construction shown in FIG. 5 are mounted on the cylinder head of the engine as shown in FIG. 6 and a spark gap h is formed between center electrodes f of the spark plugs 4. In FIG. 6, numeral 6 designates a cylinder head, 7 a cylinder, and 8 a piston.

The operation of the apparatus of the first embodiment of this invention having the above-described construction will now be explained. When a positive voltage is applied to a terminal a of one of the spark plugs 4 and a negative voltage or a voltage of the opposite polarity is applied to a terminal a of the other one of the spark plugs 4, a spark discharge occurs at the spark gap h thereby to ignite a mixture gas. In this embodiment, a high tension circuit including the plugs 4 and the secondary winding 3*b* of the ignition coil 3 is floating or insulated from the vehicle body, and thus, the magnitude of a high voltage occurring at insulated portions of each of the plugs 4 at the time of occurrence of a spark discharge, when seen from the vehicle body, becomes one half the magnitude of a high voltage occurring at the center electrode of the prior art apparatus shown in FIGS. 1 and 3, respectively. As a result, a withstand voltage for each of high tension components including the spark plugs 4 may be halved as compared with a conventional value. Thus, as compared with the conventional spark plug shown in FIG. 3, the length of an insulator b may be halved approximately and therefore it is possible to miniaturize the spark plug assembly as a whole. Further, a conventional spark plug has a disadvantage that the projection of the center electrode into the combustion chamber entails an increase of the length of the ground electrode so as to form the spark gap therebetween, thereby overheating the ground electrode and increasing its wear and making it impossible to provide the spark plug with a sufficient heat range, whereas, the spark plugs used in the above-described embodiment include no ground electrode and hence have an advantage of being capable of solving these problems.

Next, a description will be made of remarkable functional effects of the apparatus of the first embodiment of this invention which have been proved by a comparison experiment including a fouling test.

Figure 3:
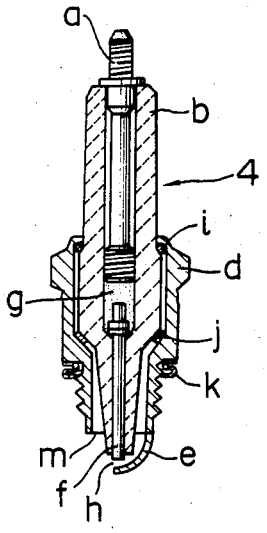
FIG. 3 PRIOR ART
FIG. 3 is a sectional view showing a spark plug for use in the prior art apparatus.
Figure 7:
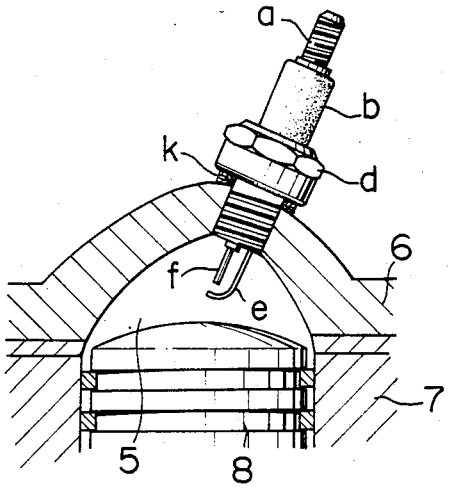
FIG. 7 PRIOR ART
FIGS. 7 and 8 are partially sectional views respectively showing states of mounting spark plugs for use in a test to investigate the functional effects of the apparatus of this invention.
Figure 8:
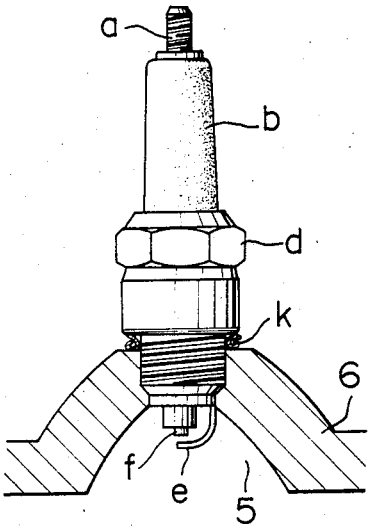
FIG. 8 PRIOR ART

This comparison test was made on a two-cycle 50 cc internal combustion gasoline engine. The state of mounting the sample spark plugs on the engine is shown in FIGS. 6, 7 and 8. The details of the sample spark plugs in FIG. 6 are as shown in FIG. 5, and the sample spark plug in FIG. 7 is the same with that shown in FIG. 5 expecting that a ground electrode has been added thereto. The details of the sample spark plug in FIG. 8 are as shown in FIG. 3.

Figure 9:
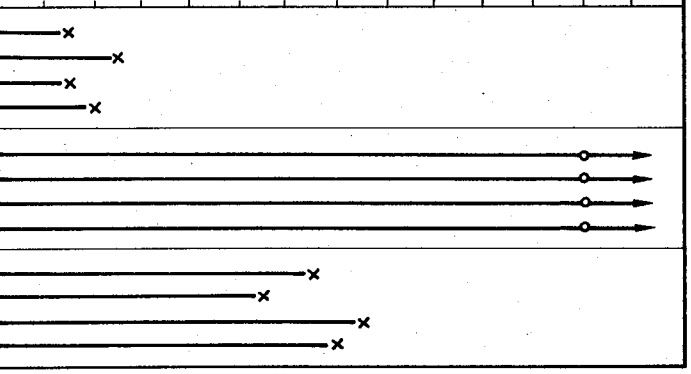
FIG. 9 is a characteristic diagram useful for explaining the function of the apparatus of this invention.

FIG. 9 shows the result of the test. In the test, the engine was operated with its choke valve fully closed (at 2000 rpm), and the time elapsed before the engine came to a standstill was measured in minutes. As will be seen from the test result, the prior art ignition apparatus of FIG. 1 can ensure the desired performance when using the spark plug with mounting threads of 14 mm in external diameter (FIG. 8), but the change of only the mounting threads of the spark plug used to 10 mm (shown in FIG. 7) renders the engine inoperable in a short period of time thus completely failing to ensure the desired performance. On the other hand, in accordance with the ignition apparatus of this invention shwon in FIG. 4, the use of the small spark plugs with mounting threads of 10 mm in external diameter can ensure the performance more than two times as fine as that of the prior art ignition apparatus. This test result indicates a remarkable effect which breaks through conventional generally-accepted common knowledge such that small spark plugs cannot be used in two-cycle engines. The advantage that such small plugs can ensure greater fouling resistance than the prior art spark plugs can be attained by the construction in which the vehicle body does not form a part of the high tension circuit of the ignition coil as the prior art ignition apparatus does, but the high tension circuit comprises only the circuit components which are electrically insulated from the vehicle body.

Figure 10:
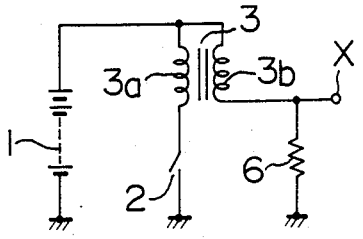
FIG. 10 PRIOR ART
FIGS. 10 and 11 are circuit diagrams useful for explaining the function of the apparatus of this invention.
Figure 11:
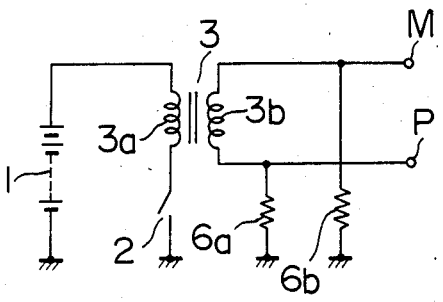
Figure 12:
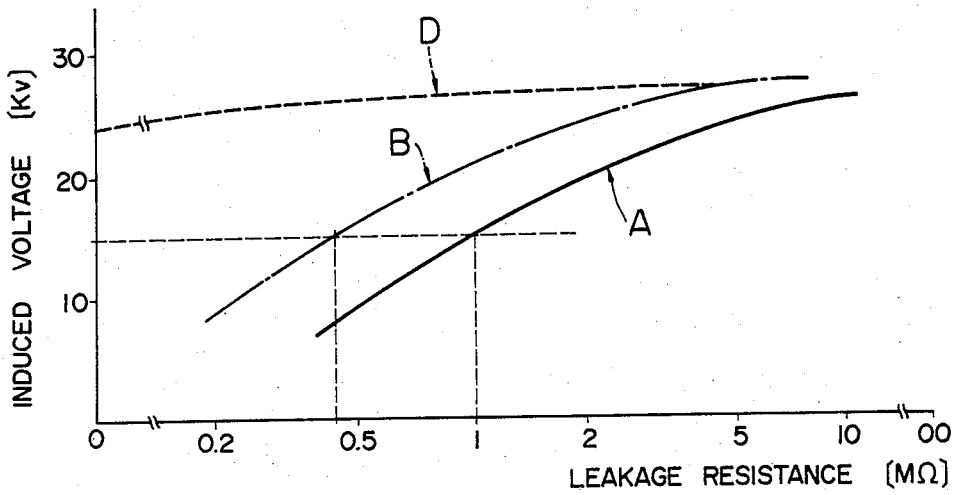
FIGS. 12 and 13 are characteristic diagrams useful for explaining the function of the apparatus of this invention.

The reason why the improvement of antifouling performance is attained will now be explained in greater detail. The fouling property of an ignition apparatus is generally given in terms of a leakage characteristic as shown in FIG. 12, wherein a comparison is made between the prior art ignition apparatus and the ignition apparatus of this invention. Then, the voltage developed across a terminal X and ground in FIG. 10 as indicating the leakage characteristic of the prior art ignition apparatus is shown at A in FIG. 12. On the other hand, the voltage developed across terminals M and P as indicating the leakage characteristic of the ignition apparatus of this invention is shown at D in FIG. 12 when the value of only one of leakage resistances 6*a* and 6*b* decreases, but it is shown at B in FIG. 12 when the value of each of the leakage resistances 6*a* and 6*b* decreases. Then, if the spark discharge voltage is assumed to be 15 KV, it will be seen that a leakage resistance of 1 Mω causes a misfiring in the prior art ignition apparatus, but even a leakage resistance of 0.5 Mω does not cause a misfiring in the ignition apparatus of this invention. Thus, even with a common ignition coil it is possible to provide a characteristic which is near to that of a capacitor discharge type ignition (C.D.I.) apparatus. This means that, whereas in the prior art ignition apparatus shown in FIG. 10 the leakage resistance 6 forms a direct short-circuiting path to ground for the spark gap, in the ignition apparatus of this invention the high tension circuit including the spark plugs and the ignition coil is electrically insulated from the vehicle body as mentioned previously, so that in the ignition apparatus of FIG. 11 no short-circuiting path is formed by the presence of only one of the leakage resistances 6*a* and 6*b*, but a short-circuiting path is formed only when both leakage resistances 6*a* and 6*b* are connected in series. This is the reason why the ignition apparatus of this invention can provide the previously mentioned remarkable functional effects.

Figure 13:
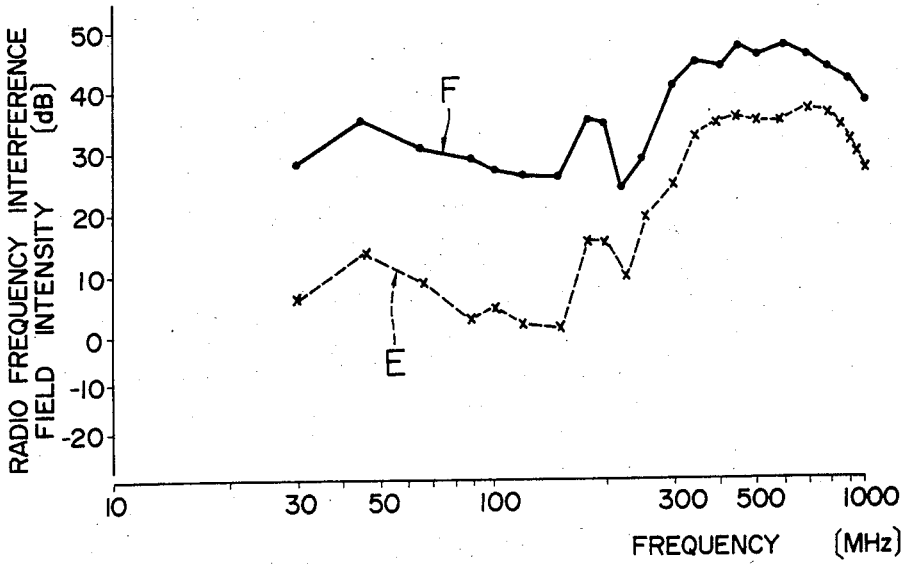

Next, referring to FIG. 13, there are shown data obtained by the measurement of radio frequency interference occurring upon the generation of a high voltage to be applied to the spark plugs. As regards the type and construction of sample spark plugs used in the measurements, the apparatus of this invention used the saprk plugs of the type shown in FIGS. 4, 5 and 6, while, the prior art apparatus used the spark plug of the type shown in FIGS. 1, 3 and 8. As will be seen from the data, in the ignition apparatus of this invention the field intensity of the radio fequency interferrence wave becomes as shown at E in FIG. 13. Thus, the apparatus of this invention has a remarkable effect of reducing the generation of the radio frequency interference wave field intensity as compared with that of the prior art apparatus shown at F in FIG. 13. The reason therefor is believed to reside in the fact that a high voltage applied to each of the spark plugs in the ignition apparatus of this invention is reduced to one half of that of the prior art ignition apparatus, when seen from the vehicle body, and besides that positive and negative voltages are respectively applied to the two spark plugs, whereby the respective electric currents flowing through the two high tension cords extending from the ignition coil to the spark plugs flow in the opposite directions.

Further, since the high tension circuit of the ignition apparatus of this invention is electrically insulated from the vehicle body, a high frequency current in the high tension circuit flows to the vehicle body through capacitance components (distributed stray capacitances) formed between the high tension circuit and the vehicle body, so that in the ignition apparatus of this invention a high frequency current flowing through the vehicle body is reduced as compared with the prior art ignition apparatus which makes a high frequency current flow directly through the vehicle body, whereby less radio frequency interference wave is radiated directly from the vehicle body. The radio frequency wave generated in the ignition apparatus of this invention originates mainly from a high frequency current within the high tension circuit. This radio frequency wave is caught by the vehicle body, and thus the energy of the radio frequency wave is converted to heat energy at various portions of the vehicle body. In other words, the vehicle body insulated from the high tension circuit acts as a radio frequency wave absorving member, and thus the radio frequency wave radiated externally from the vehicle is weakened thereby reducing radio frequency interference applied to television receivers or radio receivers outside of the vehicle and also reducing radio frequency interference applied to the electronic units installed within the vehicle.

Figure 14:
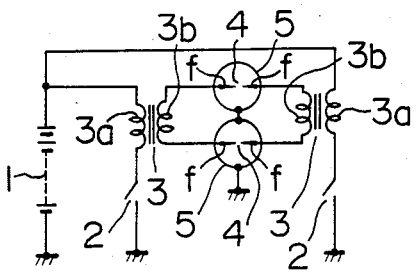
FIGS. 14 to 16 are respectively circuit diagrams of the apparatuses of second to fourth embodiments of this invention.
Figure 15:
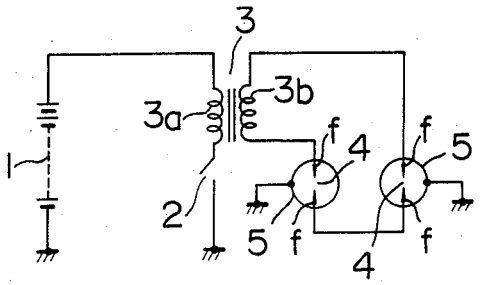
Figure 16:
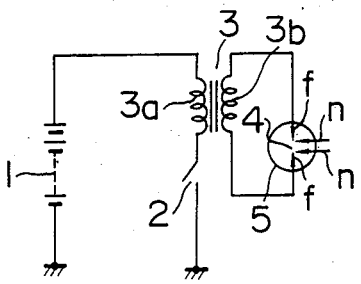

FIGS. 14 to 16 show respectively electric circuits of the ignition apparatus according to second to fourth embodiments of this invention. An explanation will be made of these embodiments. The second embodiment shown in FIG. 14 is applied to a two-cylinder internal combustion engine. It includes two ignition coils 3 and two spark plugs 4 disposed in the respective cylinders of the engine, and secondary windings 3*b* of the two ignition coils 3 are electrically connected to each other through electrodes f of the two spark plugs 4. With this construction, a high voltage is induced simultaneously in each of the ignition coils 3.

The third embodiment shown in FIG. 15 is constructed so that one of the electrodes f of two spark plugs 4 disposed in the respective cylinders of a two-cylinder internal combustion engine is connected in series with one of the ends of a secondary winding 3*b* of a single ignition coil 3.

In the second and third embodiments shown in FIGS. 14 and 15, respectively, spark discharge occurs simultaneously in the two spark plugs mounted on the respective cylinder heads. Then, electric spark occurring across the discharge gap of one of the spark plugs becomes what is called waste spark.

The fourth embodiment shown in FIG. 16 is a modification of the embodiment shown in FIG. 4. In this embodiment, two electrodes n (floating electrically) are further disposed between the electrodes f of the plugs 4. In accordance with the fourth embodiment, spark discharge between the center electrodes f of the plugs 4 occurs passing the electrodes n so that the number of electric sparks is increased thereby to improve the ignition performance. This is an application of this invention to what is called multiple-point ignition apparatus.

Figure 17:
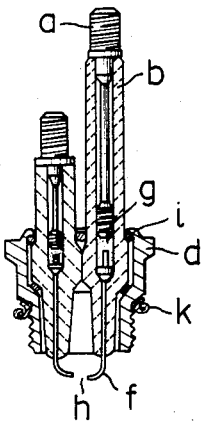
FIG. 17 PRIOR ART
FIG. 17 is a sectional view showing another example of the spark plug for use in the apparatus of this invention.

FIG. 17 shows another example of a spark plug which can be used in the ignition apparatus of this invention. This example has a construction which combines two spark plugs of the type shown in FIG. 6 in one unit.

Figure 18:
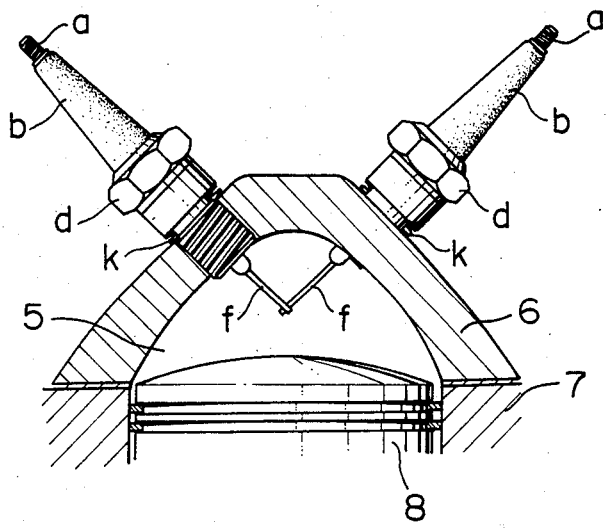
FIG. 18 is a partially sectional view showing a modification of the spark gap between the spark plugs shown in FIG. 6.
Figure 19:
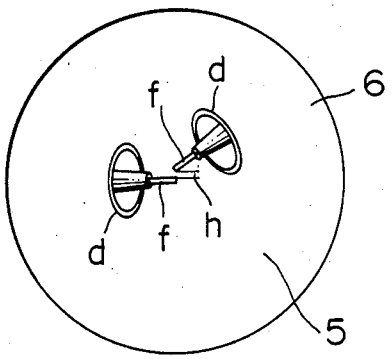
FIG. 19 is a rear view of the spark gap shown in FIG. 18 looked from inside of the cylinder head.

FIGS. 18 and 19 show an example of the modification of the arrangement of the spark plugs shown in FIG. 6 for altering the formation of a spark gap between the center electrodes of the respective spark plugs. In this example, the forward ends of the center electrodes f of the two spark plugs 4 are arranged to cross each other to form the spark gap h therebetween. With the above-mentioned arrangement, it is possible to form a spark gap more easily than the construction shown in FIG. 6.

Figure 20:
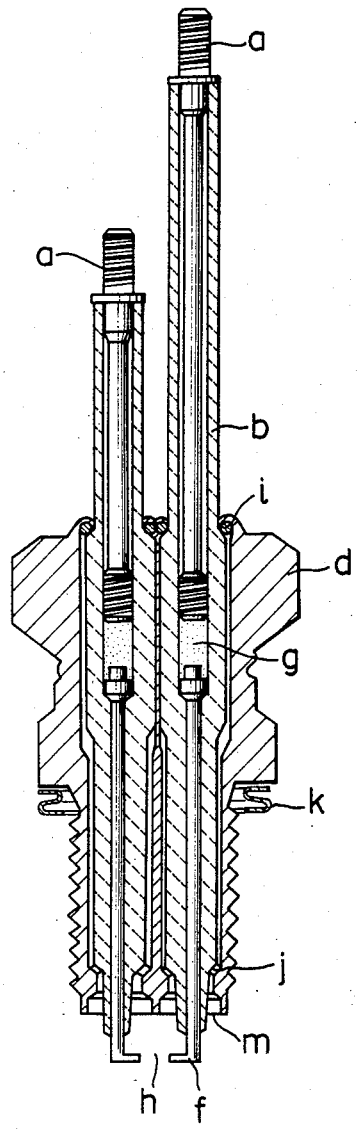
FIG.20 PRIOR ART
FIG. 20 is a sectional view showing a modification of the construction of the spark plug shown in FIG. 17.
Figure 21:
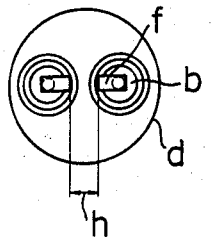
FIG.21 PRIOR ART
FIG. 21 is a bottom view of the spark plug shown in FIG. 20.

FIGS. 20 and 21 show a modification of the spark plug shown in FIG. 17 in which the forward end of each of the insulators b is formed to extend beyond the forward end m of the metal shell d so as to improve the antifouling performance.

Figure 22:
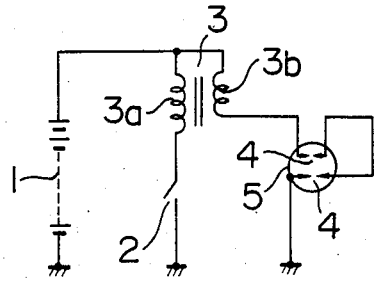
FIG.22 PRIOR ART
FIGS. 22 and 23 are respectively circuit diagrams showing examples of the circuit connections of the prior art apparatus.

There is an example of a prior art spark plug known before this invention which was disclosed by the Japanese Patent Application Kokai (Laid-Open) No. 52-156242, which describes the connection between the spark plugs used and the high tension circuit as shown in FIG. 22. In this construction, the high tension circuit of the ignition coil 3 is electrically connected to the vehicle body in the well known manner, so that a short-circuiting path for the spark gap is apt to be formed and it is not possible to expect any improvement in the antifouling performance for the reasons mentioned in connection with FIG. 10.

Figure 23:
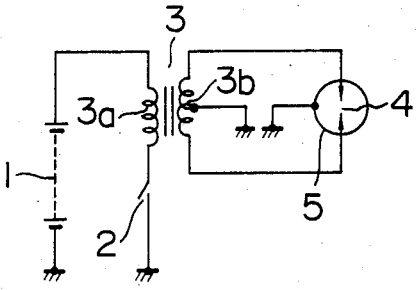
FIG.23 PRIOR ART

Another example of the prior art ignition apparatus is disclosed in Japanese Patent Publication Kokai (Laid-Open) No. 53-37245. The circuit connection disclosed therein is as shown in FIG. 23, in which the middle point of the secondary winding 3*b* of the ignition coil 3 is electrically connected to the vehicle body. In this prior art construction, the electric circuit of the secondary winding 3*b* of the ignition coil 3 includes the vehicle body (ground), so that, if one of the spark plugs is fouled with a carbon deposit or the like, a corresponding one of the output terminals of the secondary winding 3*b* of the ignition coil 3 has a leakage resistance to ground. As a result, this prior art ignition apparatus suffers from the same disadvantage as the ignition apparatus shown in FIG. 10. Thus, the spark plug fouling due to a carbon deposit or the like easily causes a leakage bypass circuit including ground to be formed for the secondary winding 3*b* of the ignition coil 3, so that it is not possible to expect the previously mentioned antifouling performance shown by this invention. It is also impossible to expect the functional effect of reducing radio frequency interference.

Next, a description will be made of a fifth embodiment of this invention which is an improvement of the spark plugs 4 used in the first embodiment of this invention and described with reference to FIG. 6. In the first embodiment shown in FIG. 6, the spark discharge gap is formed between the single center electrodes of the two spark plugs 4 and any attempt to increase the spark gap length entails a corresponding incease of the spark discharge voltage, and hence the spark gap length cannot be increased. For this reason, the two spark plugs are arranged in a state such that the spark plugs are mounted on the cylinder head of the engine in obliquely opposed relation with each other, as shown in FIG. 6, thereby to reduce the spark gap length. In this case, if the electrodes f have a straight-rod shape, the spark gap h formed between the two electrodes f of the respective spark plugs 4 is positioned only between a single point on each of the electrodes f, and it gives rise to a drawback of excessive concentration of the electric field which causes variations in the spark voltage or abnormal wear of the electrodes f.

Thus, in the fifth embodiment of this invention which will be described hereinafter, in order to prevent the occurrence of excessive concentration of the electric field between the two electrodes of the respective spark plugs, the two spark plugs are constructed so that at least one of the two electrodes of the respective spark plugs each thereof having a single electrode of a straight-rod shape has its tip end formed into a circular cone or conical frustum and the outer periphery of the tip end of the electrode of the other spark plug is positioned substantially parallel to the conical surface of the electrode of the former spark plug, thereby forming a spark gap between the two electrodes.

Figure 24:
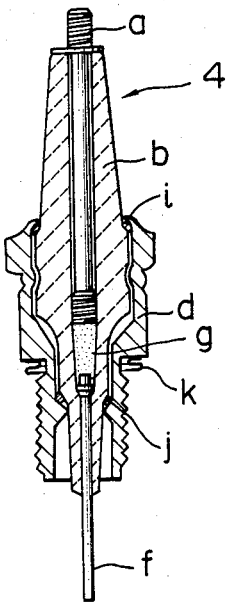
FIGS. 24 and 25 are sectional views respectively showing the spark plugs for use in a fifth embodiment of this invention.
Figure 25:
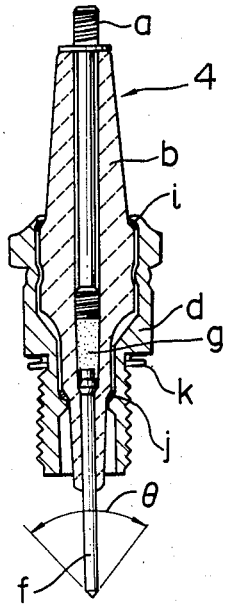

FIGS. 24 and 25 show a construction of the two spark plugs used in the fifth embodiment of this invention. In the two spark plugs 4, the spark plug shown in FIG. 24 has a construction similar to the spark plug shown in FIG. 5. On the other hand, the spark plug shown in FIG. 25 has the tip end of its center electrode f formed into a circular cone. Further, the center electrodes f of the spark plugs 4 are longer in length than the prior art spark plug shown in FIG. 5. Each of the center electrodes f has a straight-rod shape and a circular cross section.

Figure 26:
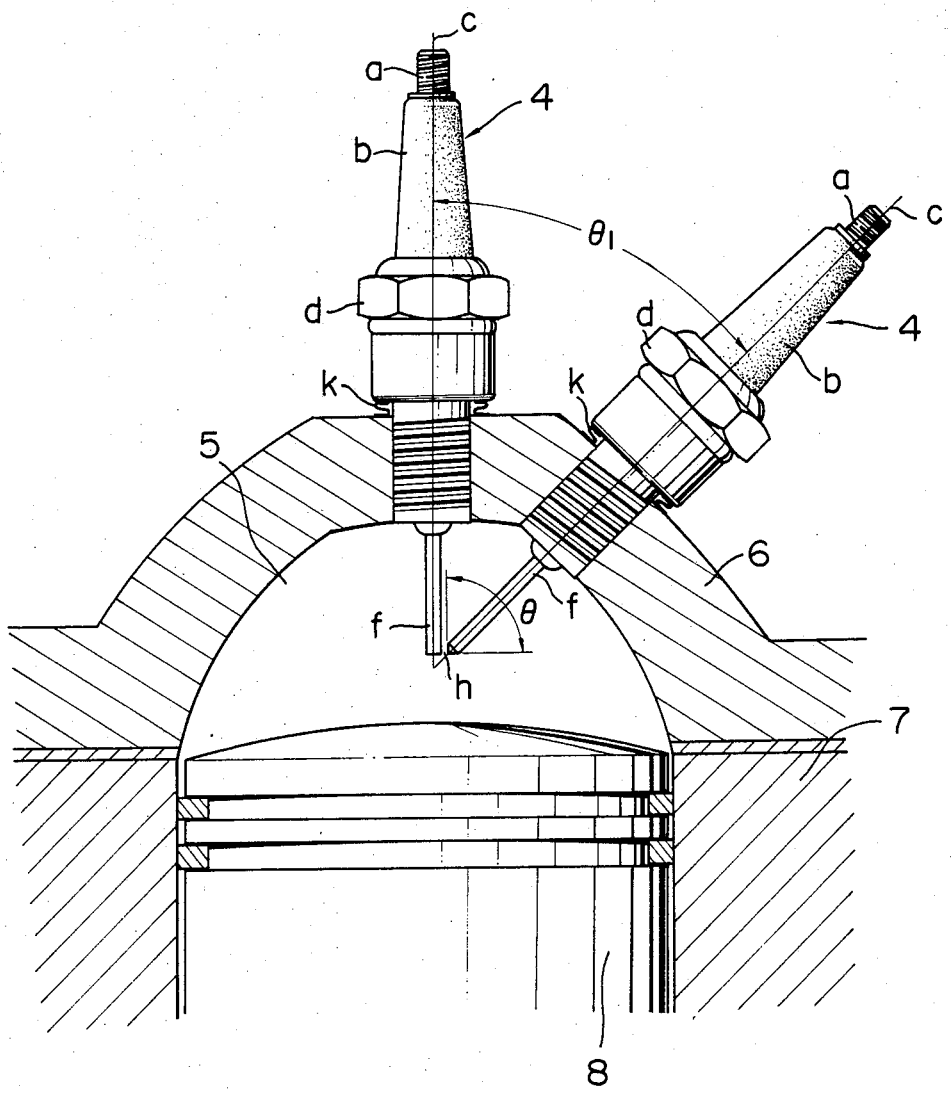
FIG. 26 is a partially sectional view showing a state of mounting the spark plugs of the fifth embodiment of this invention shown in FIGS. 24 and 25.

The state of mounting the above-described two spark plugs 4 on the engine will now be described with reference to the fifth embodiment shown in FIG. 26. The two spark plugs 4 are fixed into the cylinder head 6 as shown in FIG. 26. The spark plugs 4 are positioned in a state such that the conical surface of one of the electrodes f is parallel to the outer periphery of the other electrode f and a spark gap h is formed between the parallelly opposite portions of the respective electrodes.

Next, the operation performed by the construction of the above-described fifth embodiment will be described.

Since one of the electrodes f of the two spark plugs 4 shown in FIG. 26 has its tip end formed into a circular cone and a portion of the surface of the circular cone opposes substantially parallel to the outer periphery of the electrode f of the other spark plug 4 thereby to form the spark gap h therebetween, the opposite portions of the respective electrodes f which form the spark gap h have linear relation to each other.

By virtue of the above-described construction, the electrodes f forming the gap h do not cause the electric field to concentrate excessively at one point of each of the electrodes f as is the case with the construction shown in FIG. 6, and thus it is possible to prevent variations in the spark voltage and abnormal wear of the electrodes f due to such excessive electric field concentration.

In this case, by selecting the value of a mounting angle $\theta_1$ between the two spark plugs and that of an apical angle $\theta$ of the circular cone of the conical electrode shown in FIG. 26 to satisfy a specified condition, it is possible to easily attain the parallelly opposed arrangement of the rwo electrodes f.

Figure 27:
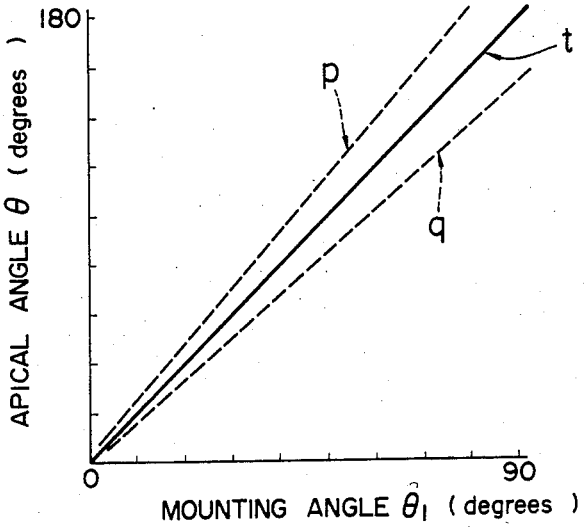
FIGS. 27 and 28 are a characteristic diagram and an explanatory drawing, respectively, which are useful for explaining the construction of the spark gap between the spark plugs of the fifth embodiment of this invention shown in FIG. 26.

Namely, the relationship between the angle $\theta_1$ (the angle made by the longitudinal axes c of the respective spark plugs 4) and the apical angle $\theta$ of the conical electrode in the fifth embodiment shown in FIG. 26 can be graphically represented as shown in FIG. 27. In the Figure, a straight line t shows the condition for the surfaces of the end portions of the electrodes f of the respective spark plugs 4 to be completely parallel to each other. In other words, so long as the relationship of the straight line t is satisfied, the spark gap h has the same magnitude along the opposite surfaces of the two electrodes f. The straight line t can be given by the following equation:

$$\theta=2\theta_1$$

However, as a matter of fact, it is highly possible that the surface of the circular cone of the conical electrode f and the outer periphery of the other electrod f do not become completely parallel to each other due to the machining accuracy of the spark plug mounting holes in the cylinder head 6, the precision of the dimension and angle of each electrode f supported in the spark plug 4, and the machining accuracy of the conical surface of the electrode f.

Figure 28:
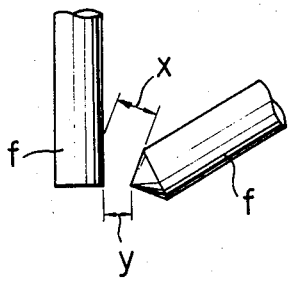

If the parallel relationship is not satisfied, the gap h includes a maximum clearance and a minimum clearance which are respectively shown at x and y in FIG. 28. If the difference (x-y) between the x and y is not reduced to less than 0.1 mm, the formation of the conical surface on the electrode f cannot produce a desired effect. Then, it has been proved that the relationship between the angles $\theta$ and $\theta_1$ should fall within the range defined by the lines p and q in FIG. 27 in order to maintain the difference (x-y) between the clearances x and y less than 0.1 mm. Each of the lines p and q becomes a parabola according to an exact computation formula.

However, it is possible to approximate each of the lines p and q by a straight line and the lines p and q can be represented by the following equations:

$$\theta=7/3\cdot\nu_1 \text{ for p, } \theta=5/3\cdot\theta_1 \text{ for q}$$

(Note that the diameter of the electrodes f is 1 mm.)

Thus, by selecting the value of the angle $\theta$ to fall within the range which satisfies the relation $5/3\cdot\theta_1<\theta<7/3\cdot\theta_1$, it is possible to arrange the conical surface of the conical electrode f and the outer periphery of the other electrode f substantially parallel to each other.

The above conditional equation shows a case where the mounting angle $\theta_1$ between the spark plugs 4 is $0°<\theta_1<90°$. However, when $90°<\theta_1<180°$, the conditional equation becomes $5/3\cdot(180°-\theta_1)<\theta<7/3\cdot(180°-\theta_1)$. (Note that the diameter of the electrodes f is 1 mm.)

Figure 29:
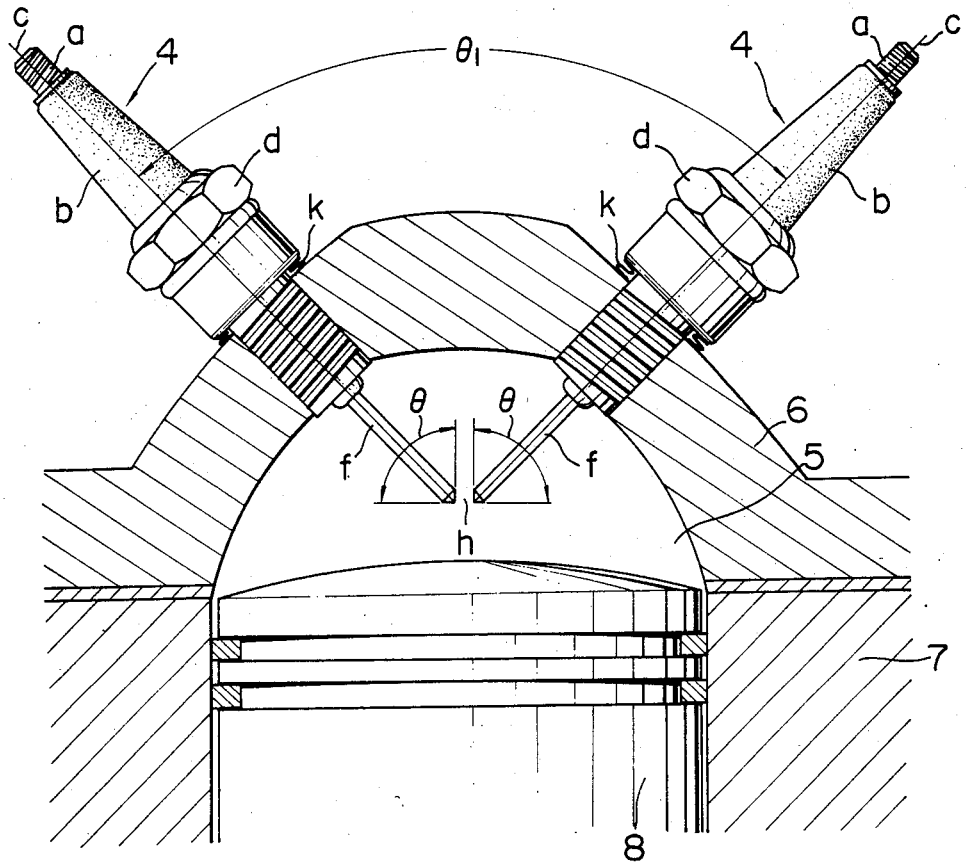
FIG. 29 is a partially sectional view showing a state of mounting the spark plugs of a sixth embodiment of this invention.

FIG. 29 shows a sixth embodiment of this invention. This sixth embodiment differs from the fifth embodiment in that both of the electrodes f of the respective spark plugs 4 have their tip ends formed into a circular cone.

Figure 30:
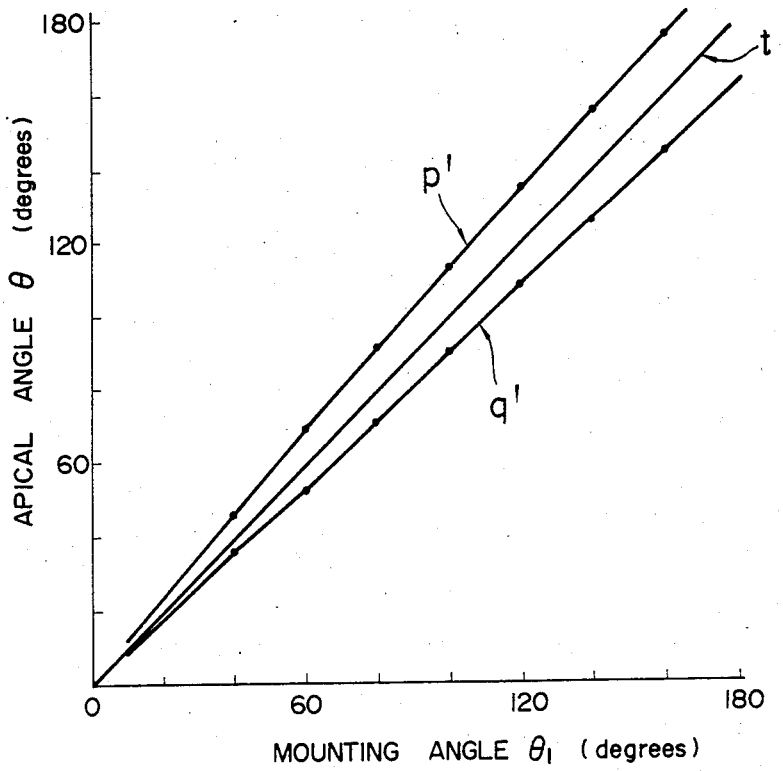
FIG. 30 is a characteristic diagram useful for explaining the construction of the spark plugs of the sixth embodiment of this invention shown in FIG. 29.

It has been found that, where each of the electrodes f of the two spark plugs 4 is formed into a conical surface as in the sixth embodiment, in order to reduce the above-defined difference (x-y) for the gap h to less than 0.1 mm, the relationship between the mounting angle $\theta_1$ between the two spark plugs and the apical angle $\theta$ of the circular cone of the two electrodes (both electrodes have the same apical angle $\theta$) should fall within the range defined by the lines p'and q' in FIG. 30. In this case, the straight line p' is represented by $\theta=7/6\cdot\theta_1$ and the straight line q' by $\theta=7/8\cdot\theta_1$. The straight line t indicates that the difference (x-y) is zero, namely, the conical surfaces of the two electrodes are completely parallel to each other. The straight line t is represented by $\theta=\theta_1$. Thus, in the sixth embodiment, the condition for the relationship between the angles $\theta$ and $\theta_1$ to fall within the range defined by the straight lines p' and q' in FIG. 30 is as follows:

$$7/8\cdot\theta_1<\theta<\alpha \text{ when } 0°<\theta_1<180°$$

where $\alpha=7/6\cdot\theta_1$ as well as $\alpha<180°$ must hold.

A description will now be made of remarkable functional effects of the ignition apparatus of the fifth embodiment of this invention which have been proved by a comparison test similar to that of the first embodiment.

Figure 1:
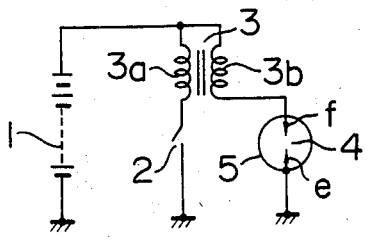
FIG. 1 PRIOR ART
FIGS. 1 and 2 are circuit diagrams showing a prior art ignition apparatus, respectively.
Figure 2:
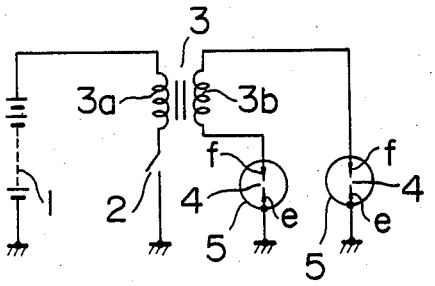
FIG. 2 PRIOR ART

The comparison test was made by using a two-cycle 50 cc internal combustion gasoline engine. In this case, the sample plugs were mounted in the same way as shown in FIGS. 26 and 8, respectively. The ignition circuit including the sample plugs mounted in the state shown in FIG. 26 is as shown in FIG. 4, and the ignitioh circuit including the sample plug of FIG. 8 is as shown in FIG. 1.

Figure 31:
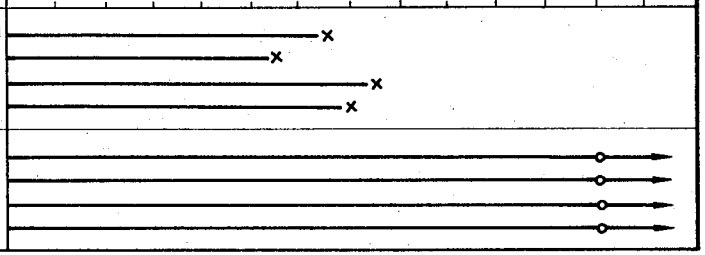
FIG. 31 is a characteristic diagram useful for explaining the function of the apparatus of the sixth embodiment of this invention.

FIG. 31 shows the result of the comparison test. The test condition was the same as that of FIG. 9. Namely, the engine was operated with its choke fully closed (at 2000 rpm), and the time elapsed before the engine came to a standstill was measured in minutes. As will be seen from the result, it has been found that the use of the prior art ignition circuit of FIG. 1 renders the engine inoperative in a short period of time and it is entirely impossible to ensure the desired performance. On the contrary, the use of the ignition circuit of FIG. 4 greatly improves the antifouling performance. The reason therefor is the same as mentioned in connection with the first embodiment. It has also been found that, in the suppression of radio frequency interference, a remarkable functional effect similar to that of the first embodiment shown in FIG. 13 can be obtained.

Next, a seventh embodiment of this invention will be described. The feature of the seventh embodiment resides in the construction thereof in which the metallic shell of a spark plug is screwed into a cylinder head of an engine so as to be electrically insulated therefrom so that the spark plug itself is electrically insulated from the body of a vehicle, the spark plug has its own spark gap forming electrodes which are connected electrically to the respective ends of a secondary winding of an ignition coil, and a high tension circuit including at least the secondary winding and the spark plug being electrically insulated from the vehicle body.

Figure 32:
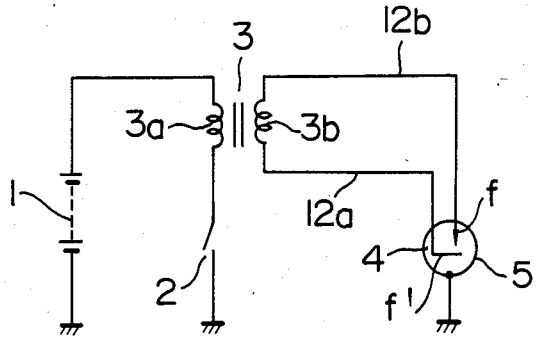
FIG. 32 is a circuit diagram of the ignition apparatus of a seventh embodiment of this invention.

The seventh embodiment of this invention will now be described in detail with reference to the drawings. FIG. 32 illustrates an electric circuit of the seventh embodiment of this invention in which embodiment the ignition apparatus of this invention is applied to a vehicle having a single-cylinder two-cycle gasoline engine, e.g., an autobicycle in the same way as the first embodiment shown in FIG. 4. The difference between the seventh embodiment shown in FIG. 32 and the first embodiment shown in FIG. 4 resides in the construction of the spark plug 4 used.

The detailed construction of the spark plug 4 used in the seventh embodiment and the state of mounting the spark plug 4 on the engine will now be described with reference to FIG. 33. In the Figure, the basic construction of the spark plug 4 is the same with that of the prior art spark plug shown in FIG. 3, so that its detailed description will be omitted but only the differences therebetween will be described. A cylindrical insulating bushing 14 made of a heat-resistant and electrically insulating material, e.g., alumina porcelain, and having threads, is screwed on the threaded mounting portion p of a metallic shell d of the spark plug 4 shown in FIG. 33. Thus, the spark plug 4 can be screwed into the cylinder head 6 of the engine by means of a threaded mounting portion 14*a* of the insulating bushing 14. A metallic gasket q is inserted between the insulating bushing 14 and the metallic shell d and further a metallic gasket k is inserted between the insulating bushing 14 and the cylinder head 6.

Numeral 15 designates a plug cap made of a heat-resistant and electrically insulating resin. A ring-shaped connector 9 made of a sufficiently electrically conductive metal is molded in the cap 15. The upper end of the connector 9 is electrically connected to a connecting terminal 11 disposed in the cap 15.

When the cap 15 is put onto the insulator b of the spark plug 4, the terminal a of the spark plug 4 is inserted in a metallic ring 13 which is electrically connected to another connecting terminal 10 disposed in the cap 15. Simultaneously, the lower end portion of the connector 9 is brought into close contact with the outer surface of the metallic shell d of the spark plug 4. Since the spark plug 4 has a construction similar to that of FIG. 3 as mentioned previously and a side electrode f' thereof is attached to the threaded mounting portion p of the metallic shell d, the side electrode f' is electrically connected to a high tension cord 12*a* through the metallic shell d, the connector 9 and the connecting terminal 11. On the other hand, a center electrode f of the spark plug 4 is electrically connected to the terminal a, and thus the center electrode f is electrically connected to a high tension cord 12*b* through the metallic ring 13 and the connecting terminal 10.

It should be noted that, since the metallic shell d of the spark plug 4 is electrically insulated from the cylinder head 6 by the insulating bushing 14 as mentioned previously, the side electrode f' of the spark plug 4 is not electrically connected via the metallic shell d to the cylinder head 6 and then to the vehicle body.

In addition, the side electrode f' of the spark plug 4 may be arranged to face the side surface of the center electrode f instead of the front end face thereof.

Next, the operation of the ignition apparatus having the above-described construction will be described. When a positive voltage is applied to the center electrode f of the spark plug 4 and a negative or a reverse polarity voltage is applied to the side electrode f' thereof, spark discharge occurs at the spark gap h thereby to ignite a mixture gas. In this embodiment, since the high tension circuit including the spark plug 4 and the secondary winding 3*b* of the ignition coil 3 is floating or insulated electrically from the vehicle body, as in the case of the first embodiment, the voltage at each of the electrodes at the time of occurrence of spark discharge is reduced, as seen from the vehicle body, to one half the voltage at the center electrode of the prior art spark plug shown in FIGS. 1 and 3.

Next, a description will be made of functional effects of the ignition apparatus of the seventh embodiment of this invention which have been proved by the previously mentioned comparison test.

Figure 34:
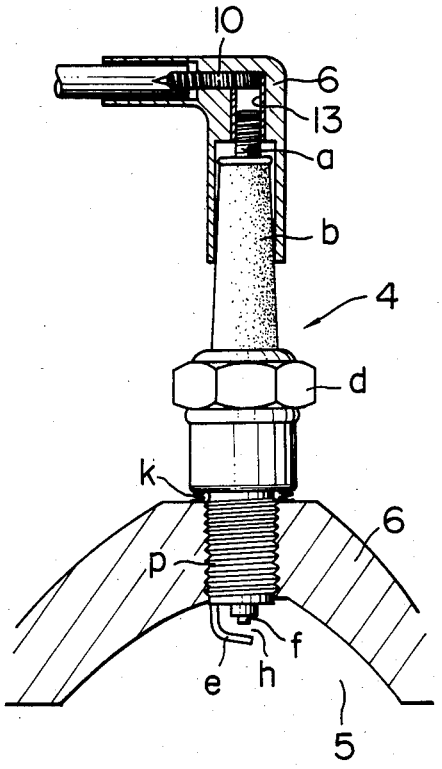
FIG. 34 PRIOR ART
FIG. 34 is a partially sectional view showing a state of mounting a prior art spark plug on the cylinder head of the engine.

The comparison test was made by using a two-cycle 50 cc internal combustion gasoline engine. The test samples included the prior art construction in which the spark plug shown in FIG. 3 was incorporated in the ignition circuit shown in FIG. 1 and was mounted on the engine in a state shown in FIG. 34 and the construction of this invention in which the spark plug shown in FIG. 33 was incorporated in the ignition circuit shown in FIG. 32 and was mounted on the engine through the insulating bushing 14 as shown in FIG. 33. The performances of the two test sample constructions were investigated and compared with each other.

Figure 35:
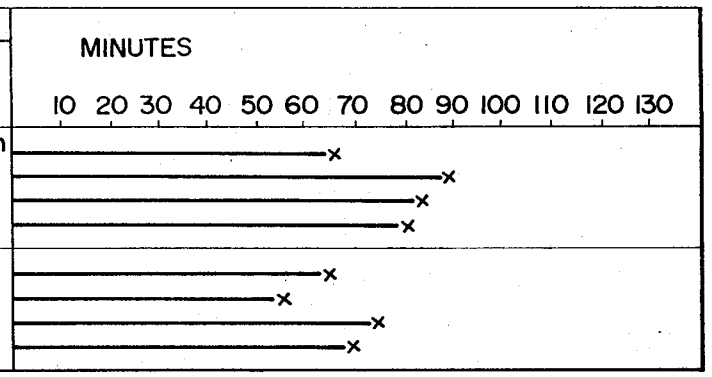
FIGS. 35 and 36 are characteristic diagrams useful for explaining the function of the apparatus of the seventh embodiment of this invention.

FIG. 35 shows the result of the test, i.e., the result of a fouling test made under the same test condition as the case of FIG. 9 in which the engine was operated with its choke fully closed (at 2000 rpm) and the time elapsed before the engine came to a standstill was measured in minutes. From FIG. 35, it will be seen that the ignition apparatus of the seventh embodiment slightly exceeds the prior art ignition apparatus in the antifouling performance.

Figure 36:
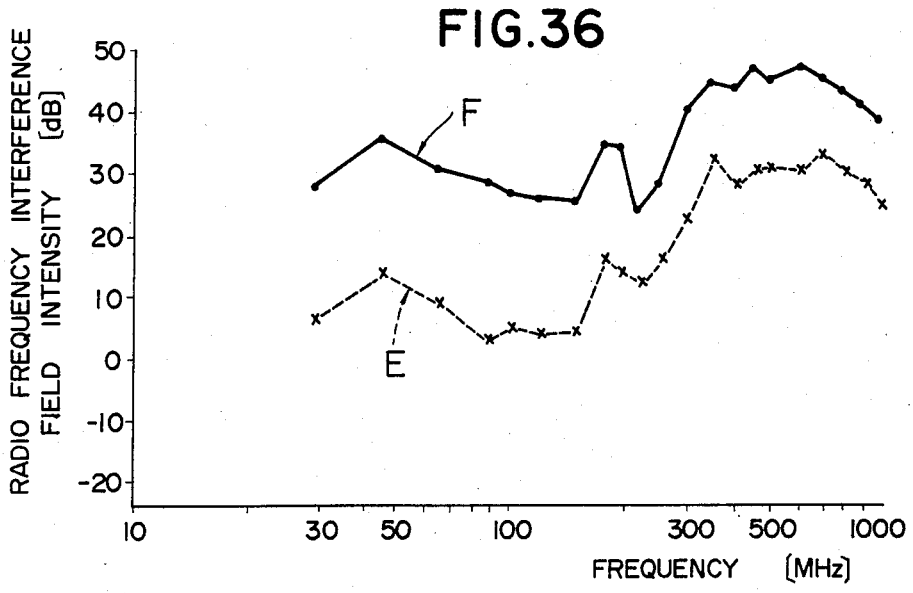

FIG. 36 shows the result of the radio frequency interference measurements conducted by using the same ignition apparatus as that used in the above fouling test. As will be seen from the result, the radio frequency interference field intensity was as shown at E in FIG. 36 when the ignition apparatus of the seventh embodiment was used, while, it became as shown at F in FIG. 36 when the prior art ignition apparatus was used, which shows that the apparatus of the seventh embodiment had a remarkable functional effect of reducing radio frequency interference. This functional effect is substantially of the same level as that of a radio frequency interference suppressing effect which can be attained by providing a radio frequency interference suppression resistor in the glass seal a (FIG. 3) of a prior art spark plug. Thus, it is apparent that, while there is no need to use such a resistor in the ignition apparatus of the seventh embodiment, the additional use of the resistor in the ignition apparatus of the seventh embodiment has an effect of further reducing radio frequency interference by 10 to 20 dB. The reason of the radio frequency interference suppressing effect of the seventh embodiment ignition apparatus is the same as that explained with respect to the first embodiment.

Figure 37:
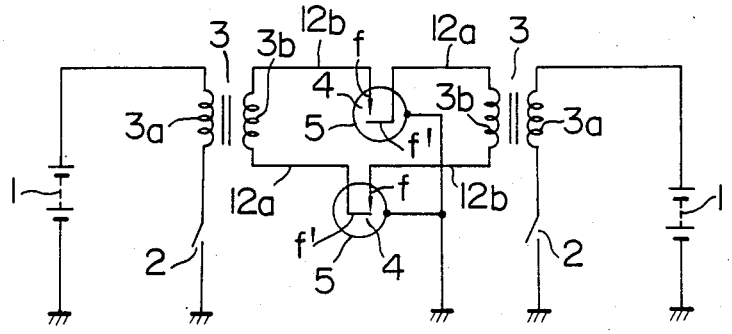
FIGS. 37 and 38 are circuit diagrams, respectively, of eighth and ninth embodiments of the apparatus of this invention.
Figure 38:
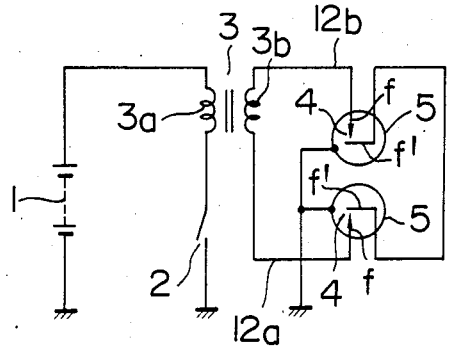

FIGS. 37 and 38 show respectively electric circuits of ignition apparatuses of eighth and ninth embodiments of this invention. In the embodiments, the eighth embodiment shown in FIG. 37 is applied to a two-cylinder engine, and it is constructed so that secondary windings 3*b* of two ignition coils 3 are electrically connected to each other through two spark plugs 4 mounted on the respective cylinder heads of the engine and a high voltage is generated simultaneously by each of the ignition coils 3.

The ninth embodiment shown in FIG. 38 is constructed so that a spark plug 4 mounted on each cylinder has its center electrode connected in series with one end of a secondary winding 3*b* of a single ignition coil 3 and their side electrodes are directly connected to each other.

In the eighth and ninth embodiments shown in FIGS. 37 and 38, respectively, spark discharge is caused simultaneously across the discharge gap of each of the plugs 4 mounted on the respective cylindr heads of the engine and electric spark occurring across the spark gap of one of the spark plugs 4 is rendered what is called waste spark.

Figure 33:
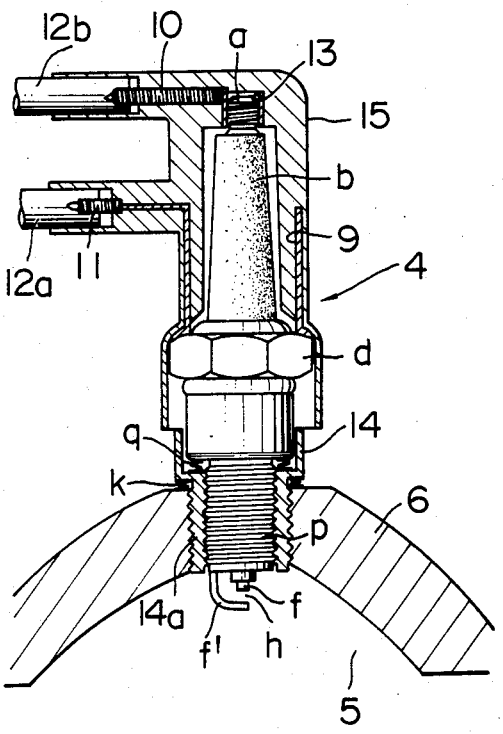
FIG. 33 is a partially sectional view showing the spark plug for use in the seventh embodiment of this invention shown in FIG. 32 and a state of mounting it on the cylinder head of the engine.

The construction of the seventh embodiment may be modified such that the spark plug 4 having the construction shown in FIG. 33 is insulated electrically from the cylinder head 6 by using, in place of the insulating bushing 14, a heat-resistant and electrical insulating coating of a polyimide resin formed on the threaded portion p of the metallic shell d of the plug 4 and in addition applying an alumina spray coating or a heat-resistant glass coating onto the threaded portion p at its side of the combustion chamber 5.

The present invention is not intended to be limited to the above-described embodiments, but the following various changes and modifications can be made thereto.

(1) Two separate plugs each thereof having a spark gap of its own may be mounted on each one of the cylinder heads of an internal combustion engine thereby providing two spark gaps for each combustion chamber of the engine.

(2) The present invention can be applied to the ignition apparatus of an internal combustion engine having four cylinders.

(3) In a multiple-cylinder engine, a distributor may be provided on the way of a high tension circuit connecting one end of a secondary winding of an ignition coil to a respective one of the two insulated electrodes of a spark plug mounted on each cylinder head.

(4) The present invention can be applied also to an ignition apparatus of the diode distribution type provided with no distributor.

(5) The ignition apparatus of this invention is not limited to its application to autobicycles, but it can of course be used also in internal combustion engines for other wide applications.

(6) This invention is applicable to an ignition apparatus not only of the battery ignition type but also of the magneto type.

From the foregoing description, it will be seen that the present invention has the remarkable functional effects which are summarized as follows:

(1) A high voltage appearing at an insulated electrode of the spark plug of the ignition apparatus of this invention at the time of spark discharge, as seen from the vehicle body, falls to one half that of a prior art type spark plug, whereby it is made easy to increase the spark gap length and raise a high voltage induced by the ignition coil, thereby improving the ignition performance;

(2) Since a high voltage appearing at each insulated electrode of the spark plug of the ignition apparatus of this invention at the time of spark discharge, as seen from the vehicle body, is lower than that of the prior art ignition apparatus, the withstand voltage design of the components of the ignition apparatus of this invention can be simplified;

(3) Since the high tension circuit including the spark gap forming electrodes and the secondary winding of the ignition coil is electrically insulated from the vehicle body, a high frequency current flowing through the high tension circuit is prevented from flowing directly into the vehicle body, whereby it is possible to have a remarkable radio frequency interference suppressing effect;

(4) By virtue of the construction described in the above paragraph (3), even if the spark plug is fouled with any electrically conductive substance such as carbon, a short-circuit path across the spark gap is hardly formed, and therefore the antifouling performance is improved greatly;

(5) It is possible to prevent excessive electric field concentration from occurring between the electrodes of the spark plug, whereby variations in the spark voltage and abnormal wear of the electrodes can be eliminated;

(6) The formation of a suitable spark gap between the electrodes is facilitated; and (7) The presence of the conical surface of a circular cone of the conical electrode increases the surface area of the electrode, which permits the the temperature of the electrode to be raised, and accordingly the spark voltage of the spark gap can be decreased.

We claim:

1. An ignition apparatus for an internal combustion engine comprising:

at least a first electrode assembly and a second electrode assembly each thereof including an electrode and mounted on a cylinder head of an internal combustion engine; and at least one ignition coil having a primary winding and a secondary winding;

each of the electrodes of said first and second electrode assemblies being electrically connected to one end of the secondary winding of said ignition coil;

each of the electrodes of said first and second electrode assemblies being supported on the cylinder head of said engine electrically insulated therefrom;

whereby a spark gap for producing spark discharge is formed between the electrodes of said first and second electrode assemblies, and a high tension circuit connecting the secondary winding of said ignition coil respectively to the electrodes of said first and second electrode assemblies is totally electrically insulated from any body of said engine; and said apparatus further comprising a spark plug which incorporates said first and second electrode assemblies and includes an electrical insulator for holding the electrode of said first electrode assembly and a mounting metallic shell fixed onto an outer surface of said electrical insulator, wherein the electrode of said second electrode assembly constitutes a side electrode which is attached to said mounting metallic shell to oppose the electrode of said first electrode assembly, thereby forming a spark gap therebetween, and wherein said mounting metallic shell of said spark plug is fitted onto said cylinder head of said engine being electrically insulated therefrom.

2. An apparatus according to claim 1, wherein an insulating bushing having a heat-resistant and electrical insulating property is fixed onto an outer surface of a portion of said mounting metallic shell of said spark plug which is fitted onto said cylinder head of said engine, and said mounting metallic shell is fitted onto said cylinder head of said engine with said insulating bushing intervening therebetween, whereby said mounting metallic shell is electrically insulated from the body of said engine.

3. An ignition apparatus for an internal combustion engine for producing an ignition spark within a cylinder head, comprising:

a spark plug including:

(a) a metallic mounting shell;

(b) a first electrode assembly, including a first electrode insulated from said metallic mounting shell and coupled to a first high voltage terminal;

(c) a second electrode assembly, including a second electrode electrically coupled to said metallic mounting shell and insulated from said first electrode and opposing said first electrode with a spark gap therebetween, said second electrode coupled to a second high voltage terminal; and (d) means for threadably screwing said mounting shell into said cylinder head to be totally insulated from said cylinder head; and ignition means for producing a high voltage spark, said high voltage spark being coupled between said first and second electrodes without any electrical connection to said cylinder head.

4. An apparatus as in claim 3 wherein said second electrode is shaped into a bent, side electrode which opposes the first electrode.

5. An apparatus as in claim 3 further comprising gasket means, coupled between said mounting shell and said mounting means for maintaining said mounting shell a predetermined distance from said mounting means and tightly coupled therewith.

6. An apparatus as in claim 5 further comprising second gasket means coupled between said mounting means and said cylinder head, for maintaining said mounting means a predetermined distance from said cylinder head.

7. An apparatus as in claim 6 further comprising two high tension wires coupled between said ignition means and said first and second high voltage terminals, wherein said first and second high tension wires arrive at said spark plug in a plane which is substantially perpendicular to an axis of said spark plug.

8. An insulating spark plug for use in a cylinder head of an engine, comprising:

an electrically conductive mounting shell having a first end which is screw threaded, a second end, and an axis extending between said two ends;

a first electrode structure, mounted on said first end of said mounting shell;

first insulating means for insulating said first electrode structure from said mounting shell;

insulating bushing means for screwing onto said screw threads on said first end of said mounting shell and adapted for coupling to said cylinder head while insulating said mounting shell from said cylinder head;

a second electrode structure, coupled to said mounting shell, and opposing said first electrode structure with a spark gap disposed therebetween;

terminal means for respectively conducting high voltage to said first and second electrode structures; and first gasket means, coupled between said insulating bushing means and said cylinder head for offsetting a distance between said insulating bushing means and said cylinder head and still allowing a tight coupling therebetween.

9. An apparatus as in claim 8 further comprising second gasket means coupled between said mounting shell and said insulating bushing means for offsetting a second distance therebetween.

10. An apparatus as in claim 9 wherein said terminal means are disposed pointing in a direction perpendicular to said axis of said mounting shell.

11. An insulating spark plug for use in a cylinder head of an engine, comprising:

an electrically conductive mounting shell having a first end which is screw threaded, a second end, and an axis extending between said two ends;

a first electrode structure, mounted on said first end of said mounting shell;

first insulating means for insulating said first electrode structure from said mounting shell;

insulating bushing means for screwing onto said screw threads on said first end of said mounting shell and adapted for coupling to said cylinder head while insulating said mounting shell from said cylinder head;

a second electrode structure, coupled to said mounting shell, and opposing said first electrode structure with a spark gap disposed therebetween; and terminal means, extending upwardly from said insulating bushing means and further disposed in a direction perpendicular to said axis of said mounting shell for providing an electrical connection to both of said first and second electrode structures.

12. An apparatus as in claim 11, further comprising first gasket means, coupled between said insulating bushing means and said cylinder head, for offsetting a distance between said insulating bushing means and said cylinder head, and still allowing a tight coupling therebetween.

* * * * *